US006536504B2

(12) United States Patent
Takeuchi et al.

(10) Patent No.: US 6,536,504 B2
(45) Date of Patent: Mar. 25, 2003

(54) CONTINUOUS STRIP CASTING DEVICE AND METHOD OF USE THEREOF

(75) Inventors: Osamu Takeuchi, Mitaka (JP); Heiji Kato, Yokosuka (JP); Toshiro Matsushita, Yokosuka (JP)

(73) Assignee: Castrip, LLC, Charlotte, NC (US)

( * ) Notice: Subject to any disclaimer, the term of this patent is extended or adjusted under 35 U.S.C. 154(b) by 0 days.

(21) Appl. No.: 09/924,820

(22) Filed: Aug. 8, 2001

(65) Prior Publication Data

US 2002/0036073 A1 Mar. 28, 2002

(30) Foreign Application Priority Data

Aug. 8, 2000 (JP) ..... 2000-239777

(51) Int. Cl.[7] ..... B22D 11/06
(52) U.S. Cl. ..... 164/415; 164/417; 164/428
(58) Field of Search ..... 164/480, 417, 164/428, 477, 415, 475

(56) References Cited

U.S. PATENT DOCUMENTS 5,590,701 A * 1/1997 Fukase ..... 164/415
5,660,224 A 8/1997 Barbe et al.
5,816,311 A * 10/1998 Osada et al. ..... 164/415
5,960,856 A * 10/1999 Blejde et al. ..... 164/480
6,079,479 A * 6/2000 Osada et al. ..... 164/428
6,209,620 B1 * 4/2001 Pleschiutschnigg ..... 164/461

FOREIGN PATENT DOCUMENTS

EP 0 780 177 12/1996
WO 94/02269 2/1994

* cited by examiner

*Primary Examiner*—M. Alexandra Elve
*Assistant Examiner*—Len Tran
(74) *Attorney, Agent, or Firm*—Barnes & Thornburg

(57) ABSTRACT

Continuous strip casting device comprises a pair of parallel casting rolls onto which molten metal is supplied by metal supply means. Casting rolls are enclosed by a casting chamber into which hot strip is delivered downwardly from the casting rolls. Strip passes downwardly into a cooling chamber where it can either fall into a moveable scrap box at the bottom of chamber or be guided by operation of moveable apron through an exit door from chamber into a heat exchange chamber provided with heaters. A pair of seal rolls are moveable in a seal chamber to form a seal between chambers and are provided with respective gas inlets to admit oxidation inhibiting gas into those chambers. Scrap box is moveable into and out of the bottom of chamber via a scrap box exchange chamber fitted with an airtight door.

24 Claims, 6 Drawing Sheets

CONTINUOUS STRIP CASTING DEVICE AND METHOD OF USE THEREOF

CROSS-REFERENCE TO RELATED APPLICATIONS

This application claims priority to and the benefit of Japanese Application Ser. No. 2000-239777, filed Aug. 8, 2000.

TECHNICAL FIELD

This invention relates to a continuous strip casting device and to a method for the use thereof.

PRIOR ART

FIG. 5 illustrates the continuous strip casting device revealed by JP 8-300108 (and also U.S. Pat. Nos. 5590701 and 5960856), such continuous strip casting device being provided with a pair of casting rolls 101*a* and 101*b* that are rotatably supported in such a manner as to be juxtaposed horizontally parallel to each other and as to form roll gap G, with the outer circumferential surfaces of the casting rolls facing the said roll gap G. A molten metal supply means 102 of the casting device supplies molten metal to and between the casting rolls 101*a* and 101*b*, and a strip guide means 112 guides sideways the strip 103 that emerges from the roll gap G through the rotation of the casting rolls 101*a* and 101*b*. A pinch roll stand 105 grips the strip 103 that has passed from the strip guide means 112. An enclosure wall 107 provides a chamber 106 that is positioned below the casting rolls 101*a* and 101*b* and encloses the moving path for the strip 103 from the roll gap G to the pinch roll stand 105, with a scrap box 108 whose upper edge is in contact from below with the edge of the chamber 106 of the enclosure wall 107.

The outer circumferential surfaces of the casting rolls 101*a* and 101*b* are cooled by means of the cooling water that flows through the interiors of the casting rolls and the solidification of the molten metal on the surfaces of the casting rolls 101*a* and 101*b* is accelerated thereby.

Moreover, an actuator (not shown) that holds in close proximity the rotational axes of the casting rolls 101*a* and 101*b* is attached in order to regulate the roll gap G, and in turn the gauge of the strip 103 that is to be manufactured.

The molten metal supply system 102 also possesses a tundish 109 that receives the molten metal, and a nozzle 110 that pours the molten metal from the said tundish 109 to and between the casting rolls 101*a* and 101*b*.

The strip guide means 112 is comprised of a support shaft 111 that is disposed below the casting roll 1010*b* and that is pivoted parallel to the said casting roll 101*b*, and a plurality of guide rolls 113 that are disposed laterally and that support the strip 103 that is transported sideways by the movable apron 112A.

The pinch roll stand 105 possesses a housing 114 through which the strip 103 passes, and a pressure roll 115*a* that is so mounted in the housing 114 as to come into contact with the lower surface of the strip 103, and a pressure roll 115*b* that is so mounted in the housing 114 as to come into contact with the upper surface of the strip 103.

The enclosure wall 107 is comprised of a steel outer shell 116 which is intended to impart support to an interior refractory lining 117 which extends across the entire inner surface of the outer shell 116.

A scrap box 108 is formed of refractory materials, and a seal member 118 is mounted in the top of the scrap box 10.

The scrap box 108 is mounted on the car 121 that has wheels 120 that are able to move over the rails 119, and has a cylinder 122 that is able to raise the scrap box 108 as provided on the said car 121.

When strip 103 is manufactured by means of the continuous strip casting device illustrated in FIG. 5, the cylinder 122 attached to the car 121 raises the scrap box 108 bringing the upper edge of the scrap box 108 through the seal member 118 into contact with the edge of the chamber 106 of the enclosure wall 107. The leading edge of the movable apron 112A is so set as to be positioned below the support shaft 111. The distance between the rotational axes of the casting rolls 101*a* and 101*b* is set so that a roll gap G corresponds to the gauge of the strip 103 that is to be cast, and the casting rolls 101*a* and 101*b* are rotated in such a manner that their outer circumferential surfaces move from above towards the roll gap G.

Next, molten steel is supplied to the tundish 109, and when the molten steel is poured through the nozzle 110 to and between the casting rolls 111*a* and 101*b*, a solidified shell forms on the outer circumferential surfaces of the rolls, and as the casting rolls 101*a* and 101*b* rotate, the strip 103 is transported into chamber 106.

After the strip 103 has been presented in a laterally uniform state, the rotational axis of the casting rolls 101*a* and 101*b* rebounds in a very short time (approximately from 0.1 to 0.5 seconds) such that the roll gap G becomes approximately 1.5 to 3 times the thickness of strip 103, and then the roll gap G reverts to its original state. The expansion in the roll gap G causes the casting rolls 101*a* and 101*b* to produce areas of imperfect cooling, so that the strip 103 melts again through reheating effectively acting as a hot shear.

In this way, the strip 103 that is transported before the expansion of the roll gap G is broken off in a straight line from the strip 103 that is transported after the roll gap G has reverted to its original state, with the portion of the strip 103 that was remelted through the expansion of the roll gap G forming the boundary of the strip 103 to be transported to the coilers.

Moreover, the movable apron 112A is disposed laterally, and the strip 103 that is transported from the roll gap G after the break is led by the guide rolls 113 to the pinch roll stand 105.

The problem addressed by the present invention is that in the continuous strip casting device shown in FIG. 5, the space formed by the enclosure wall 107 that encloses the moving path for the strip 103 from the roll gap G to the pinch roll stand 105, and the scrap box 108 that comes into contact with the lower edge of the of the chamber 106 of the enclosure wall 107, is not filled with a non-oxidizing or weakly reducing atmospheric gas, and hence scale caused by oxidation develops on the strip 103.

Moreover, no means is provided for control of the flow of the atmospheric gas (air) between the casting rolls 101*a* and 101*b* and the movable apron 112A, and between the movable apron 112A and the guide rolls 113. The high temperature air that has been heated by the strip 103 blows in a concentrated manner onto the casting rolls 101*a* and 101*b*, while the insulating effect of the refractory lining 117 of the enclosure wall 107 impedes the cooling of the air within the chamber 106. This causes reheating of the strip 103 immediately after transport from the roll gap G and breakout and instability in casting. The high temperature strip 103 (not less than 1250° C.) is transported to the pinch roll stand with scale, leading to embedded scale damage, and a likely reduction in yield.

Moreover, because the seal member 118 of the scrap box 108 is in contact with the edge of the enclosure wall 107 forming chamber 106, when an attempt is made to exchange the scrap box 108 during casting, a large amount of air flows into the chamber 106 causing severe strip oxidation. As a result, for practical purposes, it is not possible to exchange the scrap box 108 during the operation of the continuous strip casting device.

Moreover, splashes of molten metal and slag fall onto and accumulate on the seal member 118 between the enclosure wall 107 and the scrap box 108. As a result, the seal member 118 is deformed and damaged by the raising of the cylinder 122 of the scrap box 108 so that, each time the scrap box 108 is exchanged, the seal member 118 must be cleaned or replaced. Furthermore, it is difficult to restrict the inflow of external air and to maintain a low oxygen content inside the enclosing wall 107.

The present invention takes account of such deficiencies of the prior art, and enables the efficient manufacture of strip from molten steel with substantially reduced scale.

SUMMARY OF THE INVENTION

According to the invention there is provided apparatus for continuously casting metal strip comprising:

a pair of parallel casting rolls forming a nip between them;

a molten metal delivery system to delivery molten metal into the nip between the rolls to form a casting pool of molten metal supported on the casting roll surfaces immediately above the nip;

roll drive mechanism to drive the casting rolls in counter-rotational directions to produce a solidified strip of metal delivered downwardly from the nip between the casting rolls;

a casting chamber to enclose strip delivered downwardly from the nip;

a cooling chamber disposed below the casting chamber to receive the strip passing through the casting chamber from the nip through a transfer opening between the casting chamber and cooling chamber located beneath the nip between the casting rolls;

interchamber sealing system disposed at said transfer opening and having an open condition in which the opening is dilated and a closed condition in which the opening is contracted about the strip to enhance sealing between the casting and cooling chambers.

The apparatus may further comprise casting chamber gas inlet means to admit an oxidation inhibiting gas into the casting chamber. The oxidation inhibiting gas may be an inert gas or a weakly reducing gas.

There may be cooling chamber gas inlet to admit an oxidation inhibiting gas into the cooling chamber.

The interchamber sealing system may comprise a pair of seal rolls disposed on to either side of said transfer opening and a roll moving mechanism operable to move the sealing rolls between retracted positions and extended positions in which they contract the transfer opening.

The apparatus may further comprise a moveable scrap box to receive scrap strip at the bottom of the cooling chamber and a scrap box exchange chamber communicating with the bottom part of cooling chamber through an exchange opening closable by a moveable air tight door through which the scrap box can be moved in and out of its scrap receiving position at the bottom of the cooling chamber. The scrap box exchange chamber is provided with a moveable air sealing entry door through which the scrap box can pass into the exchange chamber, and with exchange chamber gas inlet through which to supply an oxidation inhibiting gas to the scrap box exchange chamber.

The apparatus may be further possess a heat exchange chamber with radiant tubes that are disposed in the heat exchange chamber. Guide rolls are disposed in the heat exchange chamber and transport laterally the strip that is sent from the cooling chamber. The heat exchange chamber is also provided with an atmospheric gas inlet.

The apparatus may also have a pinch roll chamber that communicates with the exit of the heat exchange chamber and that is able to receive the strip from the heat exchange chamber, and a partition door that is able to expand and contract in cross section the opening of the exit of the pinch roll chamber, and pinch rolls that are disposed in the pinch roll chamber and are capable of gripping the strip.

The apparatus may also have a rolling mill that is disposed in the downstream strip travel direction from the pinch roll chamber, and a strip pass line that runs from the exit of the pinch roll chamber to the rolling mill being typically so set as to lower the strip by between 10 mm and 150 mm for every 1 m distance of travel.

The invention further may provide a continuous strip casting device having a pair of casting rolls that form a roll gap and that are disposed parallel to each other in diametrical juxtaposition, and a molten metal supply system that supplies molten metal from above to and between the casting rolls, and a casting chamber that encloses the strip emerging from between the two casting rolls and in some embodiments the two casting rolls themselves, and an inter-chamber sealing system having a pair of seal rolls that permit the passage of the strip that is emerging from between the casting rolls downwards. A seal roll chamber may enclose the pair of seal rolls and communicate with or be within the casting chamber. A seal member slides the seal guide that is disposed in the seal roll chamber and positions the seal rolls in the path of and on either side of the strip in such a manner as to cause the movement of the seal rolls. A movable apron is so disposed as to guide sideways the strip that is transported downwards from between the seal rolls or alternatively to lower the said strip to a scrap box. The scrap box is disposed below the movable apron. A cooling chamber communicates with the inter-chamber sealing system and possesses an exit that is able to transport the strip that has been guided by the movable apron and that encloses the movable apron. An exit door is able to increase and decrease the cross section of the opening of the exit from the cooling chamber, and a scrap chamber possesses an air sealing door that is able to move the scrap box in and out of the cooling chamber and that encloses the scrap box that communicates with the cooling chamber, and in which the said casting chamber, cooling chamber and scrap chamber each possesses an atmospheric gas inlet.

The invention also provides a method of use of the continuous strip casting device, such method supplying an oxidation inhibiting gas such as a non-oxidizing or alternatively weakly reducing atmospheric gas, to the said casting chamber, cooling chamber and scrap chamber when strip is being continuously cast.

BRIEF DESCRIPTION OF THE DRAWINGS

In order that the invention may be more fully explained, specific embodiments will be described with reference to the accompanying drawings in which.

DETAILED DESCRIPTION OF THE DRAWINGS

Figure 1:
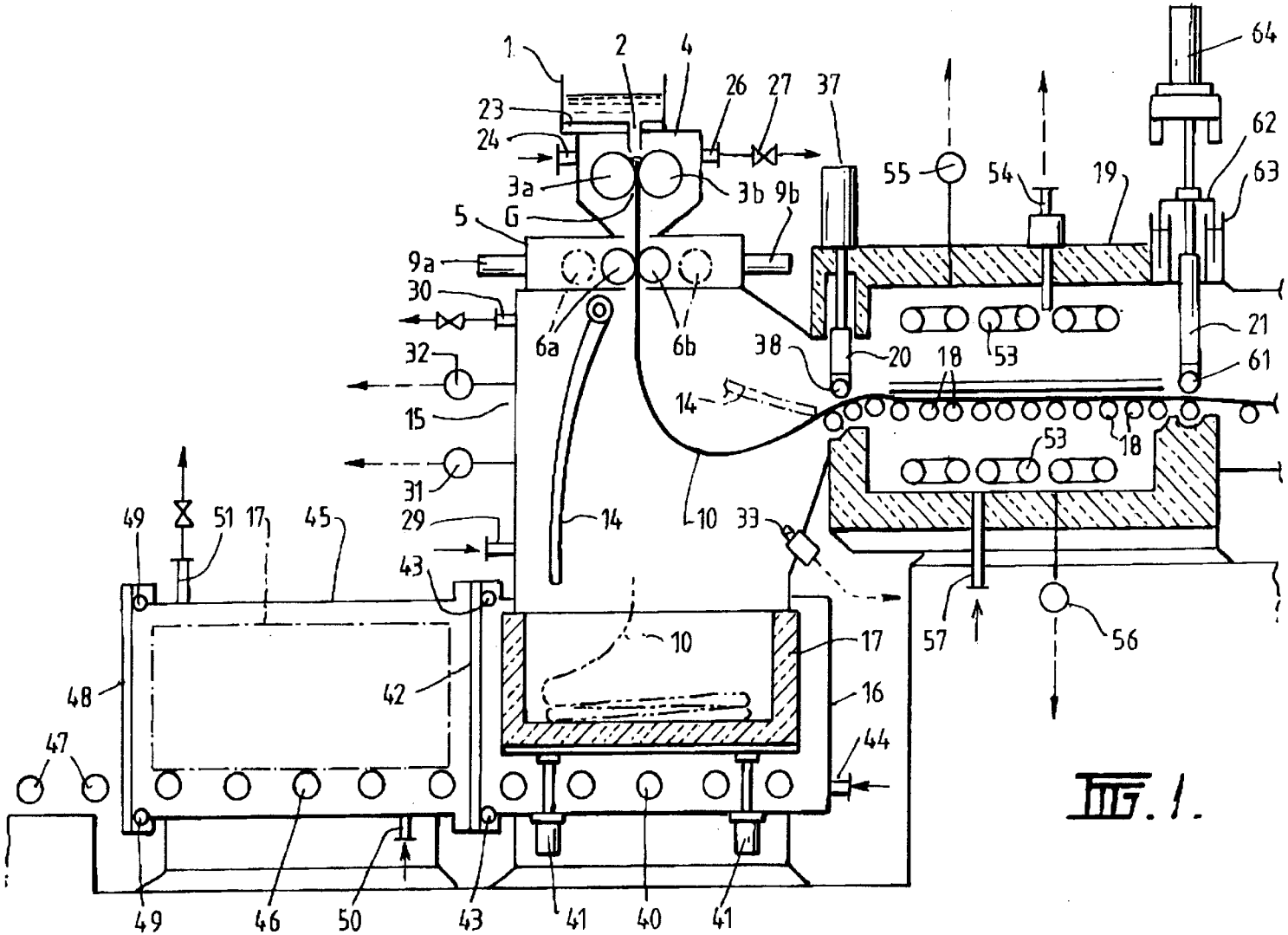
FIG. 1 is a vertical cross-section through part of a continuous strip casting installation constructed in accordance with the invention.

FIGS. 1 to 4 are an embodiment of the continuous strip casting device envisaged by the present invention.

The molten metal supply system has tundish 1 that supplies molten metal down from above through the nozzle 2 to between the casting rolls 3*a* and 3*b*. The molten metal supply system may have insulated sealing material 23 positioned between the tundish 1 and the casting chamber 4, and nozzle 2 inserted into the pool of molten steel that is formed between the casting rolls 3*a* and 3*b*.

The outer circumferential surfaces of the casting rolls 3*a* and 3*b* are cooled by cooling water that flows through them, which accelerates the solidification of the molten steel.

Moreover, the casting rolls 3*a* and 3*b* are juxtaposed horizontally in order to form the roll gap G, and the casting rolls 3*a* and 3*b* are so supported that their outer circumferential surfaces revolved from the top towards the roll gap G.

When the molten steel that flows down between the casting rolls 3*a* and 3*b* passes through the roll gap G, the molten steel forms a solidified shell on the outer circumferential surfaces of the casting rolls 3*a* and 3*b*, and strip 10 emerges downwards from the roll gap G.

Immediately after the strip 10 is separated from the outer circumferential surfaces of the casting rolls 3*a* and 3*b*, the strip may not be solidified through to the centre of its thickness, but from 30% to 50% of the central portion of the strip may be still molten steel.

In the continuous strip casting device illustrated in FIGS. 1 to 4, any non-solidified centre portion of the strip 10 is solidified after it has separated from the casting rolls 3*a* and 3*b*. However, the leading edge of the strip 10 that is transported from the roll gap G is irregular.

At this time, the seal rolls 6*a* and 6*b* are moved by the cylinders 9*a* and 9*b* to positions as indicated by the double dotted lines in FIG. 1, so that they are not affected by splash of molten metal from the roll gap G, and expand the gap between the seal rolls 6*a* and 6*b* to its largest extent. The movable apron 14 is at this time positioned facing downwards as indicated by the unbroken lines in FIG. 1.

The strip 10 that has initially been transported from the roll gap G passes through the seal rolls 6*a* and 6*b* and faces downwards and enters the scrap box 17 that is disposed inside the scrap chamber 16.

Next, after the distance between the rotational axes of the casting rolls 3*a* and 3*b* has widened in a very short period of time (typically 0.1 to 0.5 seconds), the roll gap G reverts to its original position. The expansion of the roll gap G causes liquid steel to be admitted between the strip shells and thus cause a portion of a portion of the incompletely cooled strip 10 to reheat and remelt forming a new head end suitable for transportation of the strip to the coilers.

The alignment of the movable apron 14 is then set laterally as indicated by the double dotted lines in FIG. 1. The strip 10 is thus guided onto the upper surface of the movable apron 14, onto the guide rolls 18 and passes through the exit door 20, in an open state, to the heat exchange chamber 19. The strip 10 moves through the heat exchange chamber 19 to the exit door 21, in open state, of the heat exchange chamber 20, and is then gripped by the pinch rolls 22 in the pinch roll chamber 65 so that the desired tension is then imparted to the strip 10.

The strip 10 is gripped by the pinch rolls 22 and is prevented from falling into the scrap box 17. Hence the alignment of the movable apron 14 is set in the direction indicated by the unbroken line in FIG. 1 forming a gently curving moving path for the strip 10 in the cooling chamber 15, whereby the continuous strip casting device is shifted from activation state to normal continuous casting operation.

At this time, the cylinders 9*a* and 9*b* move the pinch rolls 6*a* and 6*b* closer together, as indicated in FIG. 1, and the gap between the seal rolls 6*a* and 6*b* is reduced to a value set by the seal guide 8, and the exit door 20 of the cooling chamber 15 and the exit doors of the heat exchange chamber 21 are lowered to their lowest positions at which they do not come into contact with the strip 10.

Thus, in the continuous strip casting device illustrated in FIGS. 1 to 4 through the combination of the gap between the casting rolls 3*a* and 3*b* instantly expanding and reverting to its original state and the appropriate setting of the alignment of the movable apron 14, operation may be readily repeated, and the casting of the strip 10 may be started and stopped readily, without the necessity for the use of a dummy bar.

During continuous casting operations, the casting chamber 4 is sealed by reducing the gap between the seal rolls 6*a* and 6*b* and the strip 10. The exhaust control valve 27, apart from the exhaust vent 26, permits control of the volume of exhaust gas from casting chamber 4. Casting chamber 4 may be filled with a mixed non-oxidizing gas such as 99.99% nitrogen or argon or weakly reducing gas such as mixture from 2% to 10% hydrogen with the balance nitrogen. The gas is introduced through the atmospheric gas intake vent 24 and the atmospheric gas is exhausted through the gap between the seal rolls 6*a* and 6*b* to the cooling chamber 15, thus preventing the surface oxidation of the strip 10 that is at a temperature of between 1300° C. and 1400° C. immediately after casting in the casting chamber 4.

The casting chamber 4 consists of water cooled panels with cooling water flowing between dual outer and inner plates. The strip 10 that moves through the casting chamber 4 radiates heat to the cooling panels and is continuously cooled.

The seal roll chamber 5 communicates with both the casting chamber 4 and the cooling chamber 15, and encloses the seal rolls 6*a* and 6*b* is disposed between the casting chamber 4 and the cooling chamber 15. The seal roll chamber 5 is also constructed of water cooled panels after the fashion of the casting chamber 4, and continues cooling of the strip 10 as the strip moves from the casting chamber 4 to the cooling chamber 15.

The outer circumferential surfaces of the seal rolls 6*a* and 6*b* are cooled by cooling water that flows through the interiors of the seal rolls 6*a* and 6*b* and this accelerates the cooling of the strip 10.

The inter-chamber sealing system with seal rolls 6*a* and 6*b* is intended to reduce and may minimize the atmospheric gas that is communicated from the cooling chamber 15 to the casting chamber 4 and to minimize the movement of the gas in the casting chamber 4 in order to stabilize the casting operation. However, the gap between the seal rolls 6*a* and 6*b* can be extended at the start and finish of casting operations because splashes of molten metal may fall from the roll gap G and strip of indeterminate shape may collide with the seal rolls 6*a* and 6*b* and become entangled with them.

The sealing system with the seal rolls 6*a* and 6*b* may be comprised of sealing members 7 that are positioned on the path traversed by the strip, and which moves with the seal rolls 6*a* and 6*b*. Seal guides 8 may be disposed in the seal roll chamber 5 and extend along the entire circumference of the sealing members 7.

Sealing members 7 are formed of blocks of materials that are softer than the cast iron, ceramic or polymer resin and the like, which is employed for the seal rolls 6*a* and 6*b*, and are supported in frames sideways to the seal rolls 6*a* and 6*b*.

Moreover, the gap between the sealing members 7 and the seal rolls 6*a* and 6*b* may be set at not more than 1 mm.

Furthermore, an electric motor may also appropriately be employed in place of the oil, air or gas fluid hydraulically powered cylinders 9*a* and 9*b* as the means of moving the seal rolls 6*a* and 6*b*.

The seal guides 8 performs a sealing function for the sealing members 7 and also sets the magnitude of the gap between the seal rolls 6*a* and 6*b*.

The gap between the seal rolls 6*a* and 6*b* and the strip 10 may be set at a maximum of between 1 mm and 20 mm greater than the gauge of the strip 10, which is to be cast, in order to minimize the ingress of atmospheric gas into the casting chamber 4, while avoiding rupture of the strip 10 caused by gripping by the seal rolls 6*a* and 6*b*.

Moreover, because the gauge of the strip 10 emerging from the roll gap G normally ranges between 1 mm and 5 mm, the seal rolls 6*a* and 6*b* are also capable of being driven by the drive mechanism, for example by a electric motor, in a range of up to 20 mm.

The cooling chamber 15 is also constituted of water cooled panels after the fashion of the casting chamber 4, and the cooling of the moving strip 10 is continued in the cooling chamber 15 by means of radiant cooling.

Moreover, the outer circumferential surfaces of the movable apron 14 are cooled by cooling water that flows through the interior of the movable apron 14 and thus accelerates the cooling of the strip 10.

An atmospheric gas intake vent 29, an exhaust vent 30, a chamber internal pressure gauge 31, a gas analyzer 32 and a strip temperature gauge 33 are disposed in the cooling chamber 15, with the signals indicating the pressure by the chamber internal pressure gauge 31, indicating the gas composition by the gas analyzer 32 and indicating the temperature by a strip temperature gauge 33 being sent to a control computer that controls the internal pressure, gas composition and temperature of the cooling chamber 15.

A door roll 38 that passes cooling water into the exit door 20 of the cooling chamber 15 is attached rotatably to the bottom end of the exit door 20.

The exit door 20 of the cooling chamber 15 is set to an open state, until the leading edge of the strip 10 passes, by a drive mechanism of a door opening and closing device 37 that is powered by a fluid hydraulic or electric drive motor, and the exit door 20 of the cooling chamber 15 is set to an opening sufficient to leave a gap of between 2 mm and 10 mm to the strip 10 during continuous casting operations.

The exit door 20 of the cooling chamber 15 is constituted of insulation material, and is intended to provide insulation against radiant heat or cold from the heat exchange chamber 19.

The scrap chamber 16 is composed of water cooled panels after the fashion of the casting chamber 4 in such a manner as to communicate with the cooling chamber 15. The strip 10 is received in the scrap box 17 immediately after the start of continuous casting operations, and immediately before the conclusion of continuous casting operations.

The scrap chamber 16 is provided with an airtight door 42 to allow the insertion and removal of the scrap box 17, and a door seal 43 that is attached to the airtight door 42.

The door seal 43 preferably consists of an O ring that is formed of a heat resistant rubber material such as Viton, and an inflatable seal that expands on contact and which is provided internally with water pressure or gas pressure. The scrap chamber 16 also has an atmospheric gas intake vent 44.

Moreover, transport rollers 40 support the base of the scrap box 17. A jack 41 that raises the scrap box 17 is also provided in the base of the scrap chamber 16. The gap between the upper edge of the scrap box 17 and the edge of the opening at the bottom end of the cooling chamber 15 should be as narrow as possible when the scrap box 17 is raised by means of the jack 41, in order to prevent air leakage into the scrap box 17 from the exterior.

The scrap box 17 possess refractory materials mounted on the inside surfaces of the outer steel plates, such refractory materials providing buffers against collision when the strip 10 falls and providing insulation around the perimeter of the scrap box 17.

Moreover, the portion in which the airtight door 42 of the scrap chamber 16 is disposed communicates with the exchange chamber 45 for the placement of the scrap box 17.

The exchange chamber 45 contains an airtight door 48 for the insertion and removal of the scrap box 17, a door seal 49 for the airtight-door 48, an exchange gas intake vent 50, and a gas exhaust vent 51.

The door seal 49 preferably consists of an O ring that is formed of a heat resistant rubber material such as Viton, and an inflatable seal that expands on contact and which is provided internally with water pressure or gas pressure.

Moreover, transport rollers 46 and 47 that support the base of the scrap box 17 are disposed in the bottom of the exchange chamber 45 and outside the airtight door 48.

When the scrap box 17 is to be removed from within the scrap chamber 16, the jack 41 is retracted, and the scrap box 17 is supported on the transport rollers 40.

Next, the airtight door 42 is opened, and the scrap box 17 is moved by means of the transport rollers 40 and 46 to the exchange chamber 45, whereupon the airtight door 42 is closed, and the airtight door 48 is opened. The scrap box 17 is then moved by means of the transport rollers 46 and 47 to outside the exchange chamber 45.

When the scrap box 17 is to be sent into the interior of the scrap chamber 16, the airtight door 48 is opened and the scrap box 17 is moved by means of the transport rollers 46 and 47 into the exchange chamber 45, and the airtight door 48 is closed.

Next, the gas exhaust vent 51 is opened, the air within the exchange chamber 45 is exhausted to the exterior, and non-oxidizing or weakly reducing atmospheric gas is supplied through the exchange gas inlet vent 50 into the exchange chamber 45. The interior of the exchange chamber 45 is thus filled with atmospheric gas, and then the gas exhaust vent 51 and the exchange gas inlet vent 50 are closed.

Then the air sealing door 42 is opened, the scrap box 17 is moved by means of the transport rollers 46 and 40 into the scrap chamber 16, and the airtight door 42 is closed, whereupon the scrap box 17 is raised by means of the jack 41.

Consequently, the scrap box 17 can be exchanged during the operation of continuously casting the strip 10, without permitting the invasion of the external air, and avoiding oxidation of the strip 10.

Moreover, by providing an exhaust vacuum pump in the gas exhaust vent 51, the time required in order to replace the air with the atmospheric gas can be reduced.

If the scrap box 17 is replaced only at the conclusion of the continuous casting operation, there is no need to provide an exchange chamber 45, and the scrap box 17 can be inserted and removed simply by the opening and closing of the airtight door 42.

Moreover, wheels may be provided on the scrap box 17 in place of the transport rollers 40, 46 and 47, whereby the scrap box 17 may be moved.

When the strip 10 passes through the cooling chamber 15, the strip 10 is cooled through radiant conduction, but the strip 10 can be cooled down to not more than 1000° C. if the continuous casting velocity is low (between 30 m and 100 m/minute according to strip gauge). On the other hand, if the continuous casting velocity is high, the temperature of the strip 10 is not less than 1250° C., and temperature differences are produced laterally across the strip.

A plurality of radiant tubes 53, which may be formed of heat resistant steel or ceramic, are disposed in the interior of the heat exchange chamber 19, and insulating material is disposed on the inner surfaces of the heat exchange chamber 19. The heat exchange chamber 19 provides for correction of such differences in temperature and also controls the temperature of the strip 10 at a desired temperature within the range of from 950° C. to 1200° C., which is suitable for rolling when the strip 10 reaches the entrance to the rolling mill 76 downstream in the movement of the strip 10.

A temperature gauge 54 for measuring the temperature within the heat exchange chamber 19, a gas analyzer 55 for measuring the composition of the gas, and a pressure gauge for measuring the pressure are positioned within the heat exchange chamber 19. An atmospheric gas inlet vent 57 is also disposed within the heat exchange chamber 19, with the signals from the chamber temperature gauge being sent to the control computer. Accordingly, the fuel 59 and the combustion air 60 mixture that is sent to the burners 58 that may be attached to the radiant tubes 53 is adjusted, and the temperature within the heat exchange chamber 19 is regulated and maintained.

Alternatively, if the temperature of the strip 10 that is transported into the heat exchange chamber 19 is low, the amounts of fuel 59 and combustion air 60 that are supplied to the burners 58 that are attached to the radiant tubes 53 are increased in order to raise and again control the temperature of the strip 10.

Moreover, if the temperature of the strip 10 that is transported into the heat exchange chamber 19 is high, the supply of fuel 59 to the burners 58 is stopped, and combustion air 60 only is supplied to the burners 58 that are attached to the radiant tubes 53, in order to cool the strip 10 through the radiant tubes 53.

Heat-resistant steel rolls, and internally water cooled rolls or internally water cooled rolls to the outer circumferential surfaces of which refractory materials are attached are employed for the guide rolls 18 that are disposed in the heat exchange chamber 19.

Moreover, the output signals from the gas analyzer 55 and the chamber pressure gauge 56 are sent to the control computer which adjusts the atmospheric gas that is supplied through the atmospheric gas intake vent 57 into the heat exchange chamber 19 in order to prevent the oxidation of the strip 10.

Door rolls 61 through the interiors of which cooling water passes are rotatably mounted at the lower end of the exit door 21 of the heat exchange chamber 19.

Until the leading end of the strip 10 has passed through, the exit door 21 of the heat exchange chamber 19 is set to open by means of the door opening and closing device 64 which is operated either by a fluid hydraulic drive or by an electric motor, and the opening of the exit door 21 is so set as to provide a minimum gap in relation to the strip 10 of from 2 mm to 10 mm during the operation to continuously cast the strip 10.

The exit door 21 of the heat exchange chamber 19 is formed of steel plate to which insulating material is attached, and thus the escape of the radiant heat from the heat exchange chamber 19 is inhibited.

Moreover, a seal trough 63 that holds water may be disposed in a fixed position in relation to the heat exchange chamber 19, over the exit door 21 to the heat exchange chamber, and a seal plate 62, whose upper part is linked to the rising and falling part of the door opening and closing device 64, and whose lower end is always immersed in the seal trough 63, is also disposed over the exit door 21 of the heat exchange chamber 19. Such seal trough 63 and seal plate 64 minimize the outflow of the atmospheric gas from the heat exchange chamber 19 to the exterior.

Figure 2:
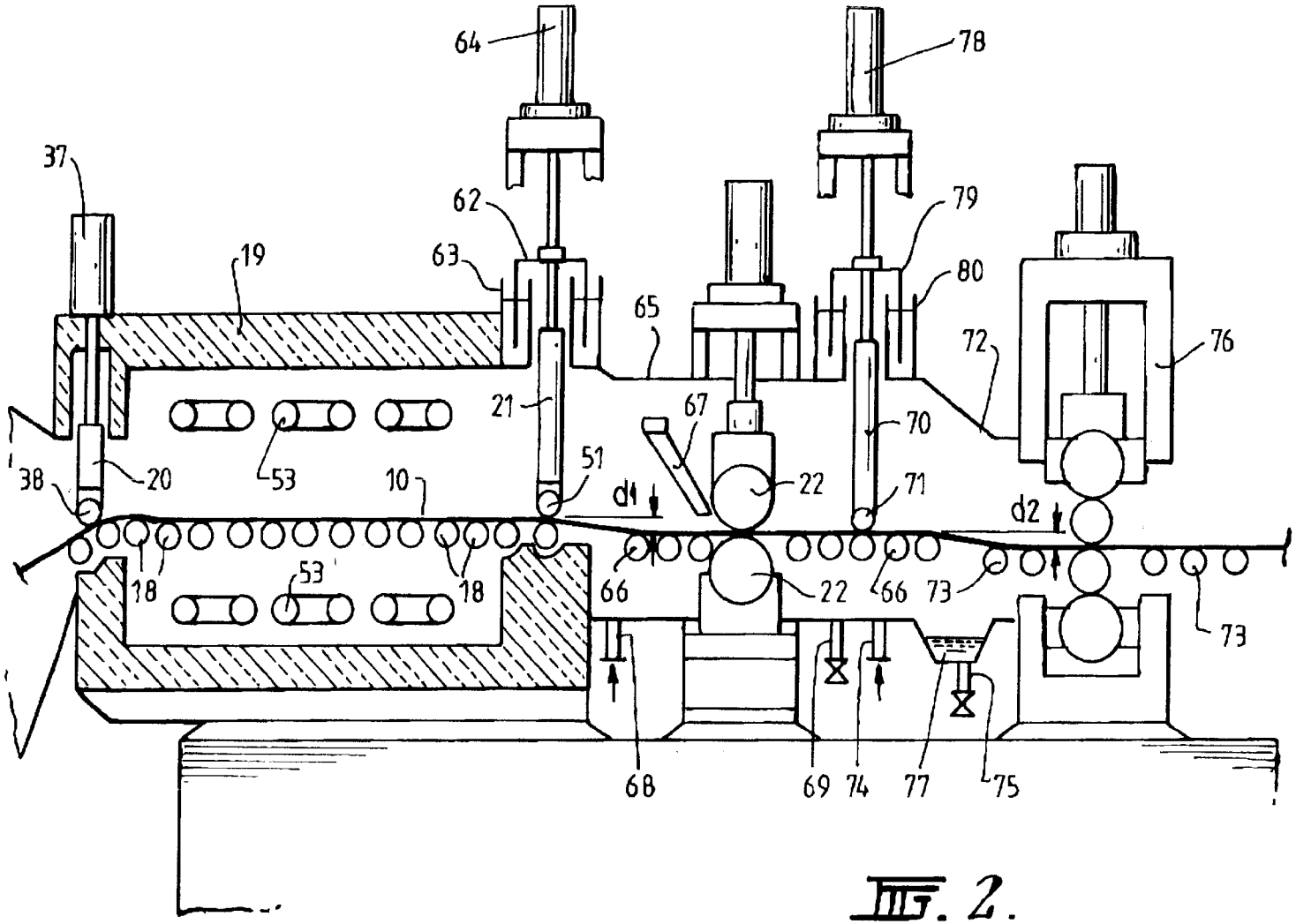
FIG. 2 is a vertical cross-section through a further part of the installation of FIG. 1.
Figure 3:
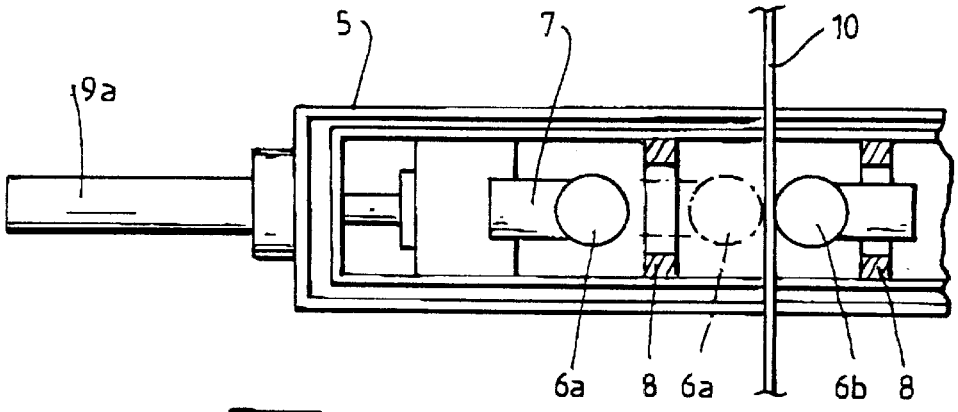
FIG. 3 is a detail view of part of the installation.
Figure 4:
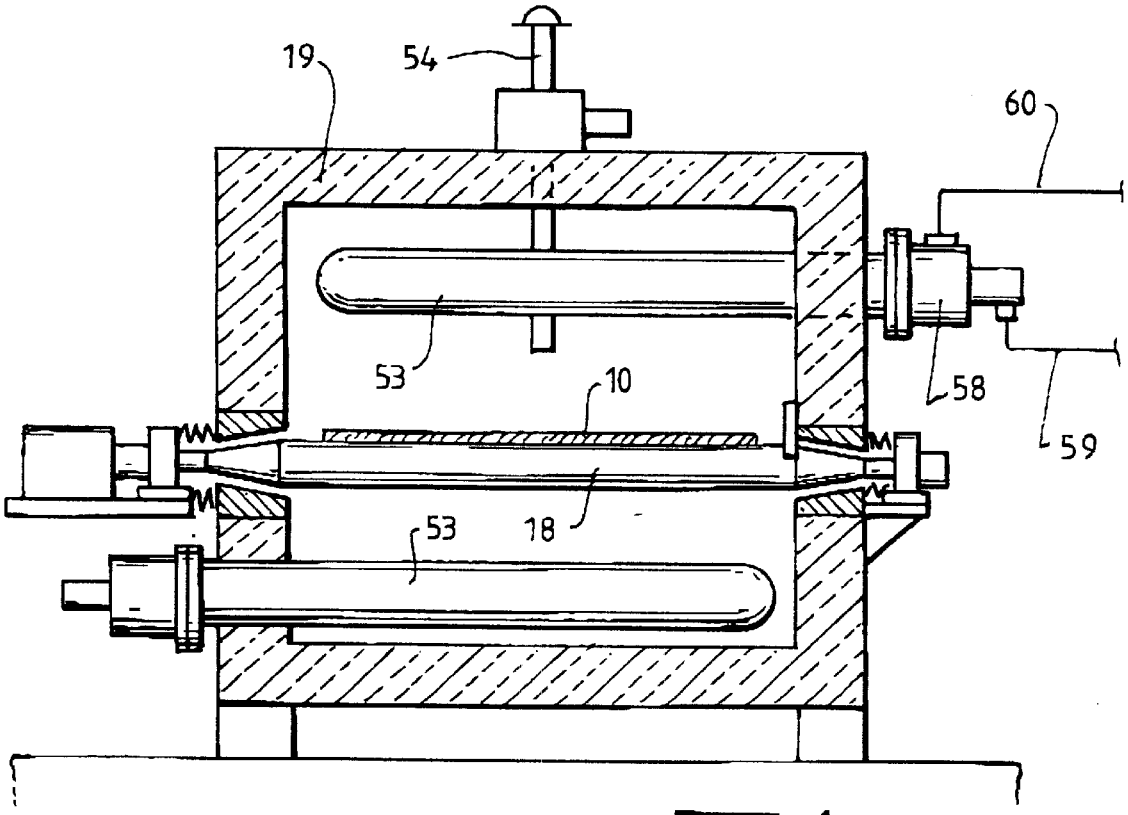
FIG. 4 is a transverse cross-section through part of the installation.
Figure 5:
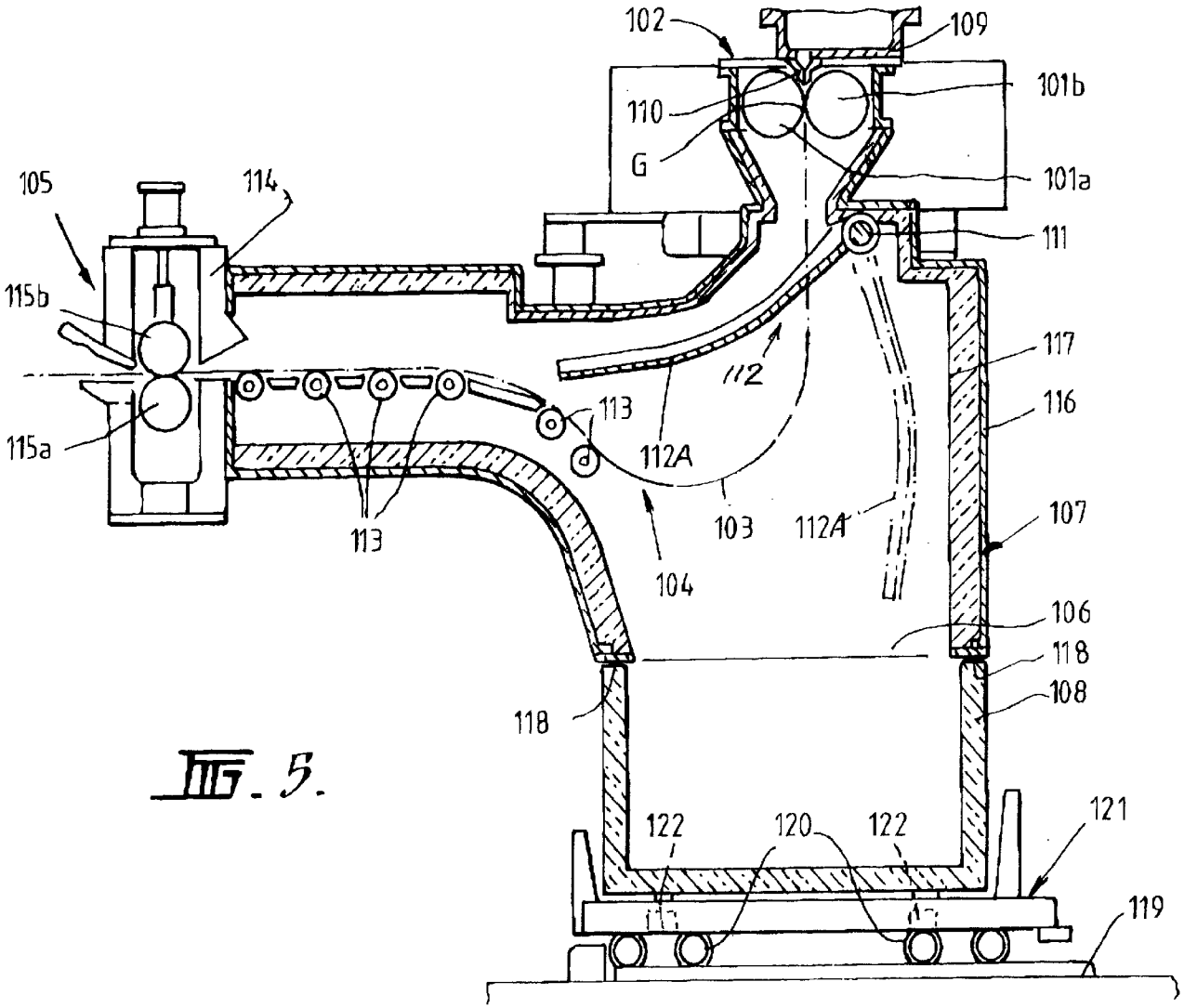
FIG. 5 illustrates part of a prior art installation.

Referring to FIG. 2, the pinch roll chamber 65 is also constructed of water cooled panels after the fashion of the casting chamber 4. The cooling of the strip 10 that is continued as it is moved into the pinch roll chamber 65.

The outer circumferential surfaces of the pinch rolls 22 are cooled by cooling water that flows through the interiors of the pinch rolls 22, whereby the cooling of the strip 10 may be accelerated.

Disposed in the pinch roll chamber 65 are transport rolls 66 supporting the strip 10 from below, and plate guides 67 permit accurate insertion of the strip 10 into the pinch rolls 22.

Also disposed in the pinch roll chamber 65 are atmospheric gas intake vent 68 that supplies atmospheric gas into the interior of the pinch roll chamber 65, and a drain 69 that drains off to the exterior lubricating oil that is sprayed onto the pinch rolls 22 and drips onto the base of the pinch roll chamber 65.

Moreover, the pass line for the strip 10 that is supported by the guide rolls 18 and the transport rolls 66 may be lowered by d1 only from the exit portion of the heat retention chamber 19 to immediately before the pinch rolls 22 in order to prevent the invasion of the heat exchange chamber by the lubricating oil.

The appropriate extent of the dip in the pass line may be between 10 mm and 100 mm per 1 m of distance travelled by the strip 10.

The path of movement of the strip 10 between the pinch roll chamber 65 and the entrance portion of the rolling mill 76 is enclosed by the pre-rolling mill chamber 72. Transport rolls 73 support the strip 10 from below are provided before and after the rolling mill 76.

The strip 10 that is transported from the pinch rolls 22 passes below the partition door 70 and enters the pre-rolling mill chamber 72, and after the strip 10 has been rolled in the rolling mill 76, the strip 10 is passed on to the downstream units.

The pre-rolling mill chamber 72 is also constructed of water cooled panels after the fashion of the casting chamber 4. The cooling of the strip 10 is continued as the strip is moved into the pre-rolling mill chamber 72.

The pre-rolling mill chamber 72 is provided with an atmospheric gas intake vent 74 in order to supply atmospheric gas to the interior of the pre-rolling mill chamber 72. A water tank 77 collects the cooling water that drips down to the base of the pre-rolling mill chamber 72 after being sprayed onto the rolls of the rolling mill 76, and a waste water drain is provided in order to drain to the exterior the cooling water from within the water tank 77. The oxidation of the strip 10 in the pre-rolling mill chamber 72 is prevented by filling the pre-rolling mill chamber 72 with atmospheric gas.

The partition door 70 is so constructed as to be internally water cooled. Hence a door roll 71 that causes the cooling water to flow inwardly is mounted rotatably in the lower end of the partition door 70.

The partition door 70 is set to an open state by a drive mechanism such as a fluid hydraulic device or an electric motor until the leading end of the strip 10 has passed, and the partition door 70 is set to a minimum opening sufficient to leave a gap of between 2 mm and 10 mm to the strip 10 during continuous casting operations.

Moreover, the pass line for the strip 10 that is supported by the transport rolls 66 and 73 may be lowered by d2 only from the partition door 70 to the entrance portion of the rolling mill 76, in order to prevent the backflow of the cooling water after it has been sprayed onto the rolls of the rolling mill 76 into the pinch roll chamber 65.

The appropriate extent of the dip in the pass line may be between 10 mm and 150 mm per 1 m of distance travelled by the strip 10.

Moreover, disposed over the partition door 70 is a seal trough 80, which holds water, is disposed in a fixed position in relation to the pre-rolling mill chamber 72, and a seal plate 79 whose upper part is linked to the rising and falling part of the door opening and closing device 78 and whose lower end is always immersed in the seal trough 80. Such seal trough 80 and seal plate 79 minimize the outflow of the atmospheric gas from the pre-rolling mill chamber 72 to the exterior.

Moreover, Table 1 shows the changes over time in each portion when nitrogen gas is supplied at a rate of 500 $Nm^3$/hr to a continuous strip casting device illustrated in FIGS. 1 to 4, and when nitrogen gas is supplied at a rate of 2000 $Nm^3$/hr and when nitrogen gas is not supplied to the device revealed by JP 8-300108.

TABLE 1

| | Present invention | | JP 8-300108 | | |
|---|---|---|---|---|---|
| Item | After 1 hour from commencement of casting | After 6 hours from commencement of casting | After 1 hour from commencement of casting | After 6 hours from commencement of casting | After 6 hours from commencement of casting, with nitrogen gas injection |
| internal pressure (strip pass line) | 10 Pa | 10 Pa | 2 Pa | 1 Pa | 5 Pa |
| Amount of atmospheric gas injected into casting chamber and cooling chamber ($Nm^3$/hr) | 500 | 500 | 0 | 0 | 2000 |
| Amount of oxygen in casting chamber | ≦100 ppm | ≦100 ppm | 10% | 18% | 6% |
| Ternperature of gas in casting chamber (° C.) | ≦200 | ≦200 | 500 | 1000 | 1000 |
| Temperature of gas in cooling chamber or enclosure (° C.) | ≦800 | ≦800 | 1300 | 1100 | 1200 |
| Thickness of oxidized scale on strip at cooling chamber or exit from enclosure (μm) | ≦0.02 | ≦0.02 | 20–30 | 30–50 | 8–20 |
| Yield of cast strip (%) | 95 | 95 | 85 | 80 | 87 |

The device envisaged by the present invention and illustrated in FIGS. 1 to 4 possesses seal rolls 6*a* and 6*b* and is therefore able to maintain a low level of oxygen in the casting chamber, such that it is possible to restrict the formation of scale on the strip 10 due to oxidation to not more than 0.02 microns. It is also possible to provide the temperature within the casting chamber 4 to not more than 700° C.

Thus in the present invention, the path of movement of the strip 10 that is transported from the casting rolls 3*a* and 3*b* is filled with a non-oxidizing or weakly reducing atmospheric gas, such as to enable an increase in the yield of the strip 10.

Figure 6:
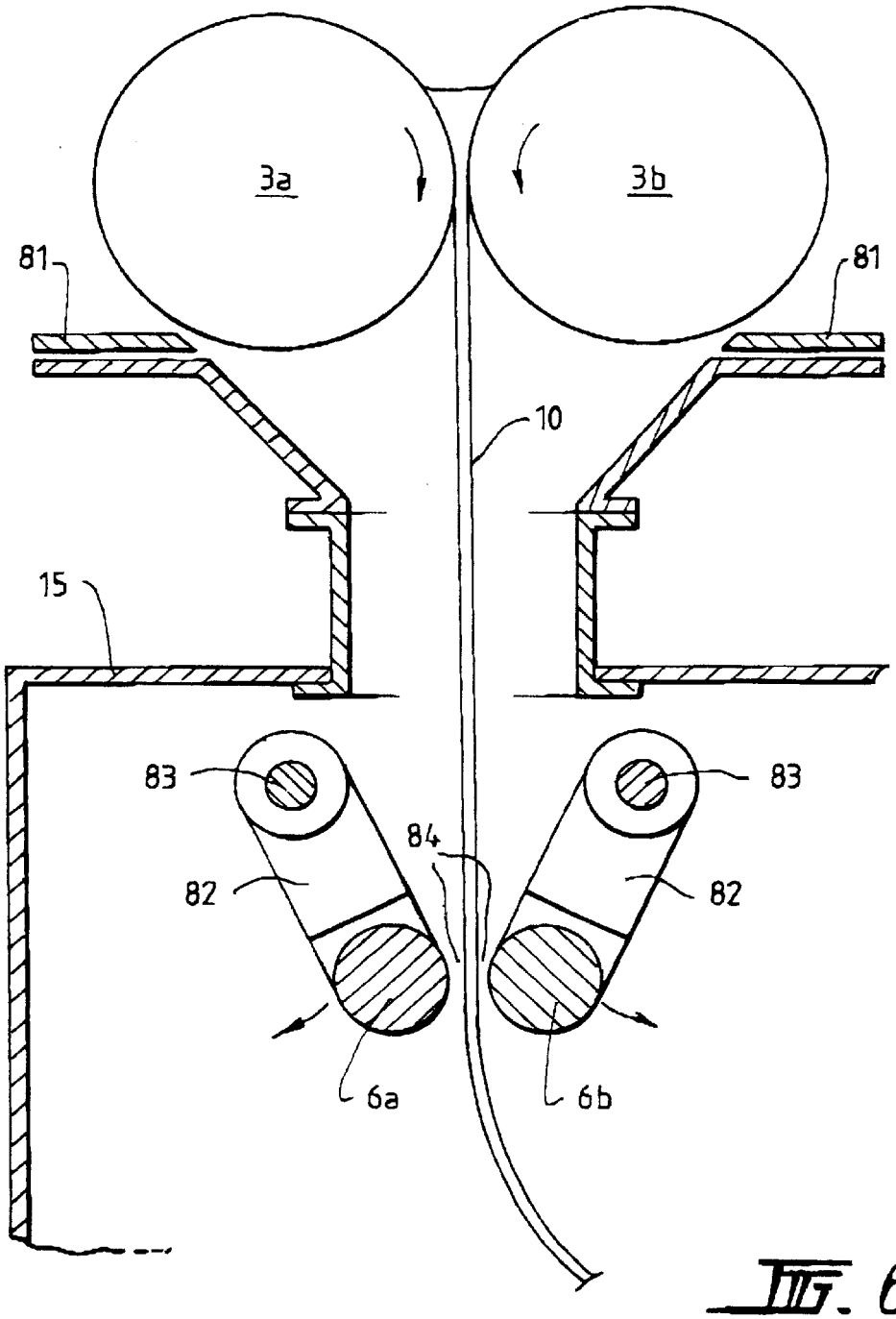
FIG. 6 is a vertical cross-section through part of an alternative continuous casting installation in accordance with the present invention.
Figure 7:
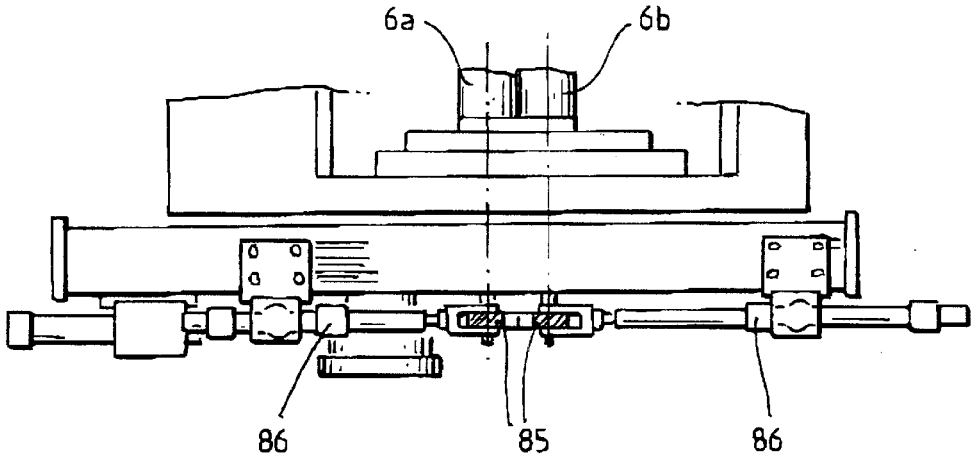
FIG. 7 is a top view of part of the installation of FIG. 6.
Figure 8:
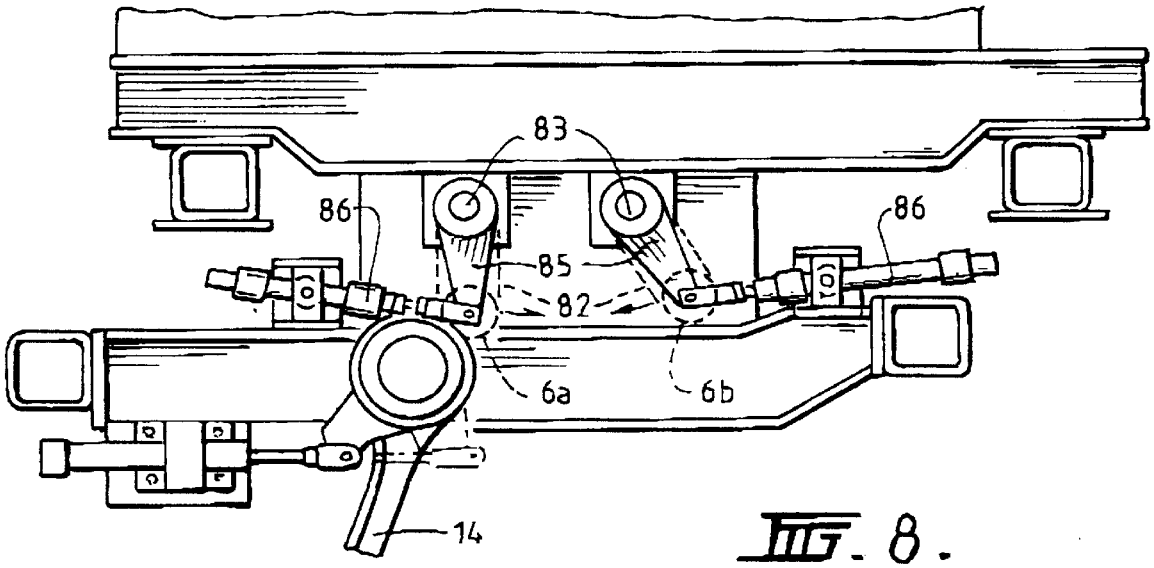
FIG. 8 is a front view of the installation components illustrated in FIG. 7.

FIGS. 6 to 8 illustrate a modified embodiment of the invention in which the inter-chamber sealing system between the casting and cooling chambers has a pair of pivoting closures rather than sliding closures as in the previous embodiment. Moreover, in this modified construction, the casting chamber 4 does not enclose the casting rolls 3*a* and 3*b*, but is sealed against the underside of those rolls so as to enclose the strip 19 as the strip emerges from the gap between the casting rolls 3*a* and 3*b*.

In the modified caster illustrated in FIGS. 6 to 8, the casting chamber 4 is substantially sealed against the underside of those rolls by seal plates 81. Further, in this modified construction the seal rolls 6*a* and 6*b* are mounted on a pair of pivoting flaps 82 hanging from horizontal pivots 83 about which they are pivotable from positions below the casting chamber 4 and open to the positions shown in FIG. 6 in which their lower parts are swung inwardly toward the strip 10 to close the transfer opening 84 through which the strip passes from the casting chamber 4 to the cooling chamber 15.

As shown in FIGS. 7 and 8, the pivot shafts 83 for flaps 82 extend to one side of the chambers 4 and 15, where they are fitted with actuator links 85 by which they can be actuated by a pair of actuating cylinder units 86 to swing the flaps 82 between their retracted positions and the positions in which they tend to close the opening between the casting chamber 4 and cooling chamber 15. In all other respects the casting installation may be generally in accordance with the previous embodiment as illustrated in FIGS. 1 to 4.

What is claimed is:

1. Apparatus for continuously casting metal strip comprising:

a pair of parallel casting rolls forming a nip between them;

a molten metal supply system to delivery molten metal into the nip between the rolls to form a casting pool of molten metal supported on the casting roll surfaces immediately above the nip;

roll drive mechanism to drive the casting rolls in counter-rotational directions to produce a solidified strip of metal delivered downwardly from the nip between the casting rolls;

a casting chamber to enclose strip delivered downwardly from the nip;

a cooling chamber disposed below the casting chamber to receive the strip passing downwardly from the casting chamber from the nip through a transfer opening between the casting chamber and cooling chamber;

an inter-chamber sealing element disposed directly adjacent to said transfer opening and movable between an open condition in which the opening is dilated and a closed condition in which the opening is contracted about the strip to enhance sealing between the casting and cooling chambers to reduce transfer of gas therebetween.

2. Apparatus as claimed in claim 1, further comprising a casting chamber gas inlet to admit an oxidation inhibiting gas into the casting chamber.

3. Apparatus as claimed in claim 1 further comprising a cooling chamber gas inlet to admit an oxidation inhibiting gas into the cooling chamber.

4. Apparatus as claimed in claim 1, wherein inter-chamber sealing element comprises a pair of seal rolls disposed one to either side of said transfer opening and a roll moving drive operable to move those rolls between retracted positions and extended positions in which they contract the transfer opening.

5. Apparatus as claimed in claim 4, wherein the seal rolls are moveable in a seal roll chamber disposed between the casting and cooling chambers and containing seal members moveable with the seal rolls to provide sealing between the casting and cooling chambers when the seal rolls are moved to their extended positions.

6. Apparatus as claimed in claim 4, wherein the inter-chamber sealing element comprises a pair of pivoting flaps hanging from horizontal pivots about which they are pivotable from positions in which the bottom of the casting chamber is open to positions in which their lower parts are swung inwardly toward the strip to close the transfer opening.

7. Apparatus as claimed in claim 6, wherein the lower parts of the flaps are fitted with seal rolls to provide the sides of the transfer opening.

8. Apparatus as claimed claim 1, wherein the casting chamber encloses the casting rolls.

9. Apparatus as claimed in claim 1, wherein the casting chamber is sealed against the underside of the casting rolls.

10. Apparatus as claimed in claim 1, wherein the cooling chamber is provided with a strip outlet disposed below and laterally to one side of the nip between the casting rolls, and the apparatus further comprises a moveable strip guide apron disposed within the cooling chamber and operable to guide the strip delivered through the transfer opening into the cooling chamber to the laterally displaced strip outlet of the cooling chamber.

11. Apparatus as claimed in claim 10, wherein the strip guide apron is moveable to an inoperative position in which it allows strip to pass downwardly to the bottom of the cooling chamber, and the apparatus further comprises a moveable scrap box to receive scrap strip at the bottom of the cooling chamber.

12. Apparatus as claimed in claim 10, further comprising a scrap box exchange chamber communicating with the bottom part of cooling chamber through an exchange opening through which to move the scrap box in and out of its scrap receiving position at the bottom of the cooling chamber, the opening of scrap box exchange chamber being provided with a moveable air sealing entry door through which to pass the scrap box into the exchange chamber and exchange chamber gas inlet means through which to supply an oxidation inhibiting gas to the scrap box exchange chamber.

13. Apparatus as claimed in claim 10, further comprising a heat exchange chamber to receive strip from the cooling chamber through the cooling chamber exit opening, strip temperature control means within the heat exchange chamber operable to heat or cool strip passing through the heat exchange chamber to control the temperature of the strip, and a heat exchange chamber gas inlet to admit an oxidation inhibiting gas into the heat exchange chamber.

14. Apparatus as claimed in claim 13, wherein the heat exchange chamber has a strip outlet opening provided with a moveable door operable to increase and decrease the size of the strip outlet opening.

15. Apparatus as claimed in claim 13, further comprising a pinch roll chamber to receive strip from the strip outlet opening of the heat exchange chamber, a pair of pinch roll within the pinch roll chamber operable to draw the strip through the pinch roll chamber and a pinch roll chamber gas inlet to admit an oxidation inhibiting into the pinch roll chamber.

16. Apparatus as claimed in claim 15, wherein the pinch roll chamber has a strip outlet opening provided with a moveable door operable to increase and decrease the size of that opening.

17. Apparatus as claimed in claim 10, wherein the strip outlet opening from the cooling chamber has a moveable door operable to increase and decrease the size of the opening.

18. Apparatus as claimed in claim 11, wherein the strip outlet opening from the cooling chamber has a moveable door operable to increase and decrease the size of the opening.

19. Apparatus as claimed in claim 12, wherein the strip outlet opening from the cooling chamber has a moveable door operable to increase and decrease the size of the opening.

20. A continuous strip casting device characterized by being provided with a pair of casting rolls that form a roll gap and that are disposed parallel to each other in diametrical juxtaposition, and a molten metal supply system that supplies molten metal-from above to between the casting rolls, and a casting chamber that encloses the two casting rolls, and a pair of seal rolls that permit the passage of the strip that emerges from between the casting rolls, and a seal roll chamber that encloses the pair of seal rolls and that communicates with the casting chamber, and a seal member that slides a seal guide that is disposed in the-seal roll chamber and that is positioned on the path of the strip in such a manner as to cause the movement of the seal rolls, and a movable apron that is so disposed as to guide sideways the strip that is transported from between the seal rolls and alternatively to lower said strip to a scrap box that is disposed below the said movable apron, and a cooling chamber disposed below the seal roll chamber that possesses an exit that is able to transport to the exterior the strip that has been guided by the movable apron and that encloses the movable apron that communicates with said seal roll chamber, and an exit door that is able to increase and decrease the cross section of the opening of the exit of said cooling chamber, and a scrap chamber that possesses an air sealing door that is able to move the scrap box in and out and that encloses the scrap box that communicates with the cooling chamber, and in which said casting chamber, cooling chamber and scrap chamber each possesses an atmospheric gas inlet.

21. A continuous strip casting device as in claim 20, further characterized by possessing an exchange chamber that possesses an air sealing door that is able to move the scrap box in and out and that communicates with the scrap chamber, and an air sealing door that is able to divide said exchange chamber and the scrap chamber.

22. A continuous strip casting device as in claim 20, further characterized by possessing a heat exchange chamber that possesses an exit that is able to send to the exterior the strip from the cooling chamber and that communicates with the exit of the cooling retention chamber, and radiant tubes that are disposed in the heat exchange chamber, and guide rolls that are disposed in the heat exchange chamber and transport laterally the strip that is sent from the cooling chamber, the heat exchange chamber being provided with an atmospheric gas inlet.

23. A continuous strip casting device as in claim 22, further characterized by possessing a pinch roll chamber for the cooling apparatus that communicates with the exit of the heat exchange chamber and that is able to send to the exterior the strip in the heat exchange chamber, and a partition door that is able to expand and contract in cross section the opening of the exit of said pinch roll chamber, and pinch rolls that are disposed in the pinch roll chamber and that are capable of gripping the strip.

24. A continuous strip casting device as in claim 23 further characterized in that a rolling mill is disposed in the downstream strip travel direction from the pinch roll chamber, the strip pass line that runs from the exit of the pinch roll chamber to the rolling mill being so set as to lower the strip by between 10 mm and 150 mm for every 1 m distance of travel.

* * * * *